US005681372A

United States Patent [19]

Magits

[11] Patent Number: 5,681,372

[45] Date of Patent: Oct. 28, 1997

[54] OIL RESERVOIR VENT SYSTEM WITH OIL SEPARATOR AND METHOD THEREOF

[75] Inventor: Hans Magits, Leuven, Belgium

[73] Assignee: Atlas Copco Airpower, N.V., Belgium

[21] Appl. No.: 580,441

[22] Filed: Dec. 27, 1995

[30] Foreign Application Priority Data

Dec. 27, 1994 [BE] Belgium ..... 09401167

[51] Int. Cl.[6] ..... B01D 46/00

[52] U.S. Cl. ..... 95/273; 55/339; 55/421; 55/428; 55/467; 55/DIG. 19; 95/284; 96/189; 123/41.86

[58] Field of Search ..... 95/273, 289; 96/188, 96/189, 187; 55/339, 355, 394, 395, 421, 423, 429, 428, 467, DIG. 15, DIG. 17, DIG. 19; 123/41.86

[56] References Cited

U.S. PATENT DOCUMENTS

| | | | |
|---|---|---|---|
| 1,781,638 | 11/1930 | Green | 55/DIG. 19 |
| 2,029,216 | 1/1936 | Barker | 123/41.86 |
| 2,686,504 | 8/1954 | Hill | 123/41.86 |
| 3,016,977 | 1/1962 | Schweitzer et al. | 96/189 |
| 3,246,639 | 4/1966 | Oliver | 123/572 |
| 3,378,104 | 4/1968 | Venable | 96/188 |
| 3,509,967 | 5/1970 | Ballard | 55/DIG. 19 |
| 3,633,341 | 1/1972 | Langlois | 55/DIG. 19 |
| 4,263,029 | 4/1981 | George | 55/421 |
| 4,668,252 | 5/1987 | Gerdau | 55/338 |
| 4,878,923 | 11/1989 | Muller | 55/355 |
| 5,503,659 | 4/1996 | Crosman | 95/273 |

FOREIGN PATENT DOCUMENTS

| | | | |
|---|---|---|---|
| 56-29572 | 7/1981 | Japan | 55/DIG. 17 |
| 2 006 329 | 5/1979 | United Kingdom . | |
| 2 143 897 | 2/1985 | United Kingdom . | |

*Primary Examiner*—Jay H. Woo
*Assistant Examiner*—Duane S. Smith
*Attorney, Agent, or Firm*—Bacon & Thomas

[57] ABSTRACT

A device and method for separating oil from the vent of an oil reservoir, such as a sump of an oil-free compressor, includes a suction pump for drawing in air from the oil reservoir through a first venting line and delivering the air through a second venting line to a filter on the one hand, and a connection between the oil reservoir and the environment on the other hand. The suction pump always draws a flow at a rate which is greater than a normal venting flow to the sump such that flow through the connection is always from the environment to the oil reservoir in order to maintain a constant air content and pressure in the oil reservoir.

9 Claims, 3 Drawing Sheets

OIL RESERVOIR VENT SYSTEM WITH OIL SEPARATOR AND METHOD THEREOF

BACKGROUND OF THE INVENTION

1. Field of the Invention

The invention concerns a system for separating oil from the vent of an oil reservoir, in particular from the sump of an oil-free compressor, which device contains a filter which is connected to the oil reservoir via a vent line and in which the oil is separated from the air.

2. Discussion of the Prior Art

The vent of an oil reservoir, in particular the sump vent of a compressor, is rich in oil aerosols, both dispersion aerosols and condensation aerosols. If the sump vent opens directly into the atmosphere, air with oil could be sucked into the compressor. The compressor and especially the cooling system can also be polluted by the oil. Therefore, devices for separating oil from the sump vent have been heretofore proposed.

Such devices must by all means avoid excess pressure in the sump, since excess pressure is very disadvantageous to the sealings.

With known devices of the above-mentioned type, the sump venting line opens directly into the filter. The pressure in the sump hereby depends on the contamination of the filter element, so that there is a risk of excess pressure in the sump.

In another known device, the line is connected to a filter which is erected in a chamber in which is created an underpressure. Oil can only be discharged from the chamber by switching off the device and by pumping out the oil by means of a pump. This device has a very complex construction due to the large number of components, and if any of the above-mentioned components fails, oil can be sucked out of the sump into the device.

In other known devices, the filter is a ring-shaped, rotating filter which is mounted in a case and which is provided with blades, so that an air flow is created through the filter. Due to the centrifugal force, drops of oil which are formed in the filter are swung against the wall. The oil is collected at the bottom of the housing, from where it can be fed back to the sump. In order to obtain enough centrifugal force, the filter must have a relatively large diameter, so that it takes up a relatively large much space. A rotating filter is relatively expensive and can easily become defective. Polluted air can escape between the rotating filter and the case.

SUMMARY OF THE INVENTION

The invention aims to remedy these disadvantages and to provide a device for separating oil from the sump vent which has a simple construction, which is reliable and which excludes any building up of pressure in the oil reservoir, even when one or more components of the device fail or wear out.

This aim is reached according to the invention in that the device contains, in a line for venting, a suction pump for sucking out air from the oil reservoir on the one hand, and contains a connection between the oil reservoir and the environment (i.e., atmosphere) on the other hand.

The device is practically dimensioned, so that a flow is sucked out via the vent line which is larger than the normal venting flow, i.e. the air flow which flows into the oil reservoir via components of, for example, the compressor.

Via the connection between the oil reservoir and the environment, an air flow flows into the oil reservoir which is equal to the difference between the flow into the reservoir which is sucked out via the vent line and the normal venting flow.

The flow which is sucked out from the oil reservoir by the suction pump and the size of the connection between the oil reservoir and the environment in parallel with the line with the suction pump and the filter are preferably selected such that there is never created an excess or under pressure in the oil reservoir which is disadvantageous to the working of the sealings.

According to an advantageous embodiment of the invention, the connection between the oil reservoir and the environment parallel to the line with the suction pump and the filter also serves to let the oil separated in the filter to flow back to the gearcase.

The flow of the oil separated in the filter to the gearcase is preferably caused by the force of gravity.

According to a special embodiment of the invention, the filter is mounted in a chamber which is provided with an air outlet and which is connected to the oil reservoir via a return line.

The oil which is separated in the filter is collected in the chamber and carried back to the oil reservoir via the return line, preferably as a result of the force of gravity.

Via the return line between the chamber in which the filter is mounted and the oil reservoir, an air flow flows into the oil reservoir which is equal to the difference between the flow which is sucked out via the vent line and the normal venting flow into the reservoir.

The flow which flows into the chamber, which is dependent upon the size of the air outlet of this filter chamber and the size of the return line is preferably selected such that there is never an excess pressure or underpressure in the oil reservoir which is disadvantageous to the working of the sealings.

According to an advantageous embodiment of the invention, the suction pump is an ejector to which is connected a compressed-air line and whose suction part is connected to the oil reservoir via a part of the line.

The ejector does not contain any moving parts and thus is not subject to wear and tear.

Preferably, a pressure regulator or a restriction device is mounted in the compressed-air line.

The compressed-air line is connected to the compressed-air network onto which the compressed-air source is connected.

BRIEF DESCRIPTION OF THE DRAWINGS

In order to better explain the characteristics of the invention, the following preferred embodiments of a device for separating oil from the air vent of an oil reservoir are described as an example only without being limitative in any way, with reference to the accompanying drawings, in which.

DETAILED DESCRIPTION OF THE PREFERRED EMBODIMENTS

Figure 1:
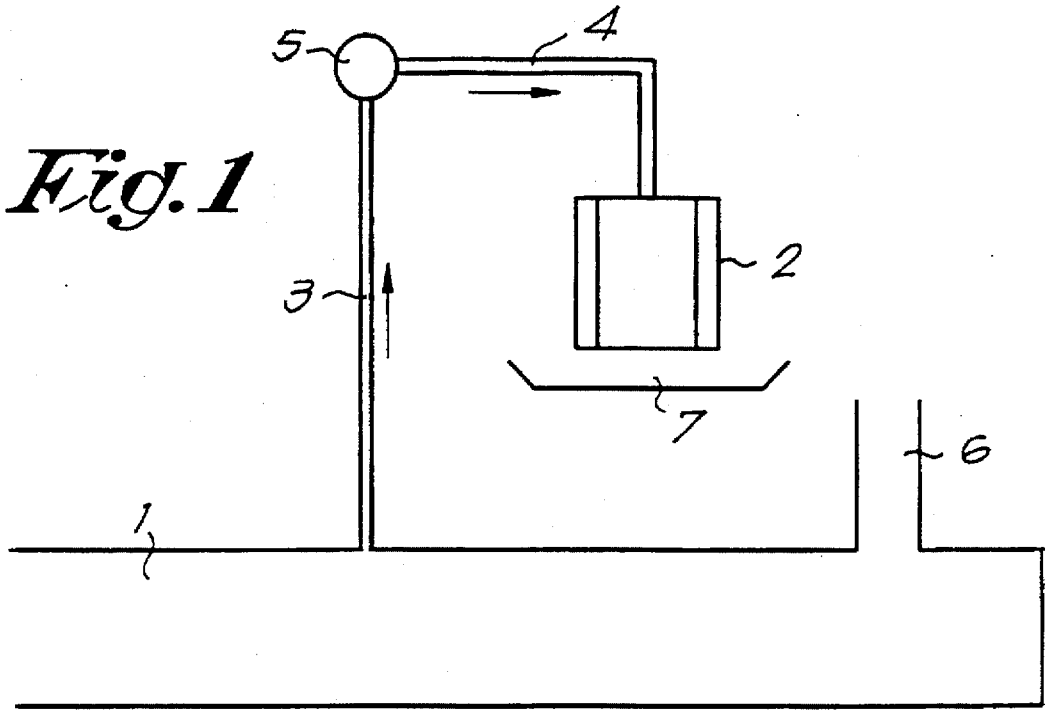
FIG. 1 schematically represents a sump onto which is mounted a device according to the invention for separating oil from the air vent.

FIG. 1 schematically represents the oil reservoir of a sump 1 of an oil-free compressor onto which is mounted a device for separating oil from the sump vent.

This device mainly contains a filter 2, a sump venting line 3-4 between the sump 1 and said filter 2, and a suction pump 5 in the line 3-4 and a connection 6 between the sump 1 and the environment or atmosphere.

The part 4 of line 3-4 is connected to a inside of the standing ring-shaped filter 2 which is mounted vertically. The filter 2 consists of spongy material which collects oil in the shape of aerosol from the air, so that larger drops of oil are formed which drip off the filter 2.

Under the filter 2 is provided a dish 7 to collect the oil.

The working of the device is as follows.

The suction pump 5 sucks out a flow Q1 of air polluted with oil via the part 3 of the line 3-4 from the sump 1. The dimensions of the device are selected such that this flow Q1 is larger than the normal sump venting flow QS, i.e. the flow which flows into sump 1 via components of the compressor and especially via the sealings around the rotor shaft.

The flow Q1 is directed via the part 4 of the line 3-4 through the filter 2.

Via an air inlet vent line or connection 6, an air flow Q1–QS flows from the environment or atmosphere to the sump 1, so that the air content in this sump is constant once the balance is reached, and so that, as a consequence, the pressure is also constant.

Polluted air can no longer flow from the sump 1 into the environment via the connection 6, since a flow Q1–QS constantly flows from the environment into the sump 1.

The flow Q1 and the size of the connection 6 are preferably selected such that there is never created an excess pressure or underpressure in the sump 1 which is disadvantageous to the working of the sealings.

Figure 2:
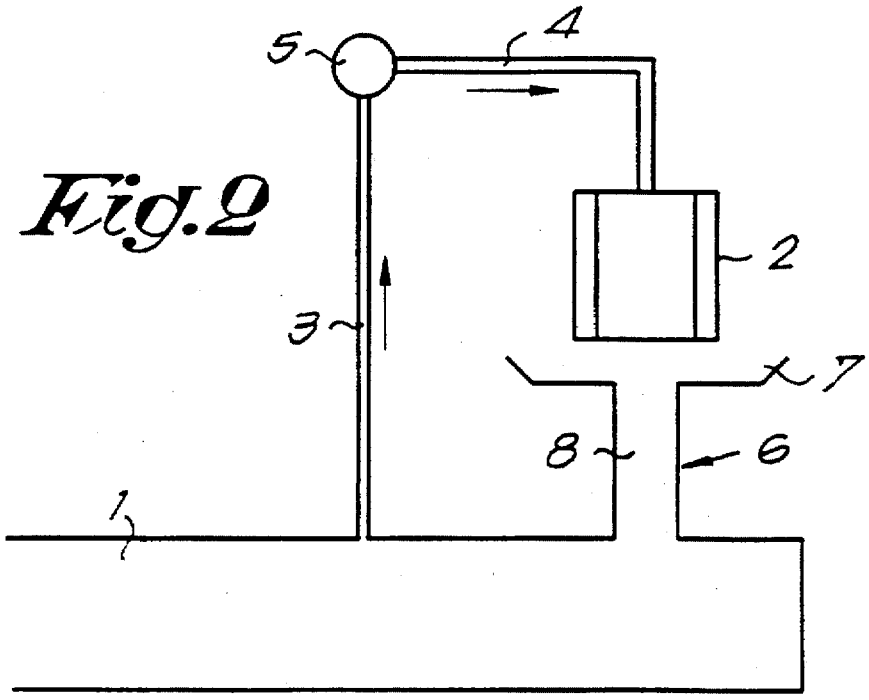
FIG. 2 schematically shows a first variant of the device for separating oil.

FIG. 2 schematically shows a variant of the embodiment.

The embodiment of the device represented in FIG. 2 differs from the above-described device in that the dish 7 is connected to the sump 1 via a return line 8. The oil separated in the filter 2 and collected in the dish 7 is carried back to the sump 1 via the return line 8 which in this variant coincides with the connection 6 to the environment.

The working of the device as represented in FIG. 2 is further identical to the working of the device as described in FIG. 1.

Figure 3:
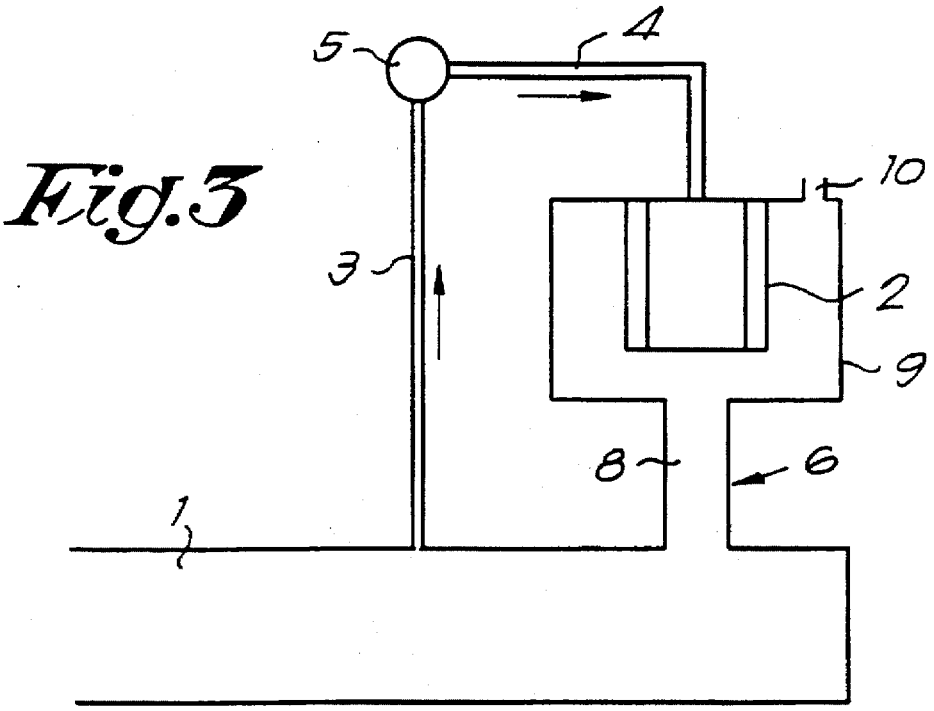
FIG. 3 schematically shows a second variant of the device for separating oil.

FIG. 3 schematically shows a second variant of the device.

The embodiment of the device represented in FIG. 3 differs from the device represented in FIG. 2 in that the filter 2 is erected in a chamber 9. The chamber 9 is provided with an outlet 10 to the environment or atmosphere.

The bottom of the chamber 9 is connected to the sump 1 via a return line 8. This return line, together with the chamber 9 and the outlet 10, forms the above-mentioned air inlet vent line connection 6 to sump 1.

The working of the device as represented in FIG. 3 is identical to the working of the device as described in FIG. 1, provided that the flow Q1, the size of the return line 8 and the size of the outlet 10 are preferably selected such that there is never created an excess pressure or underpressure in the sump 1 which is disadvantageous to the working of the sealings.

Figure 4:
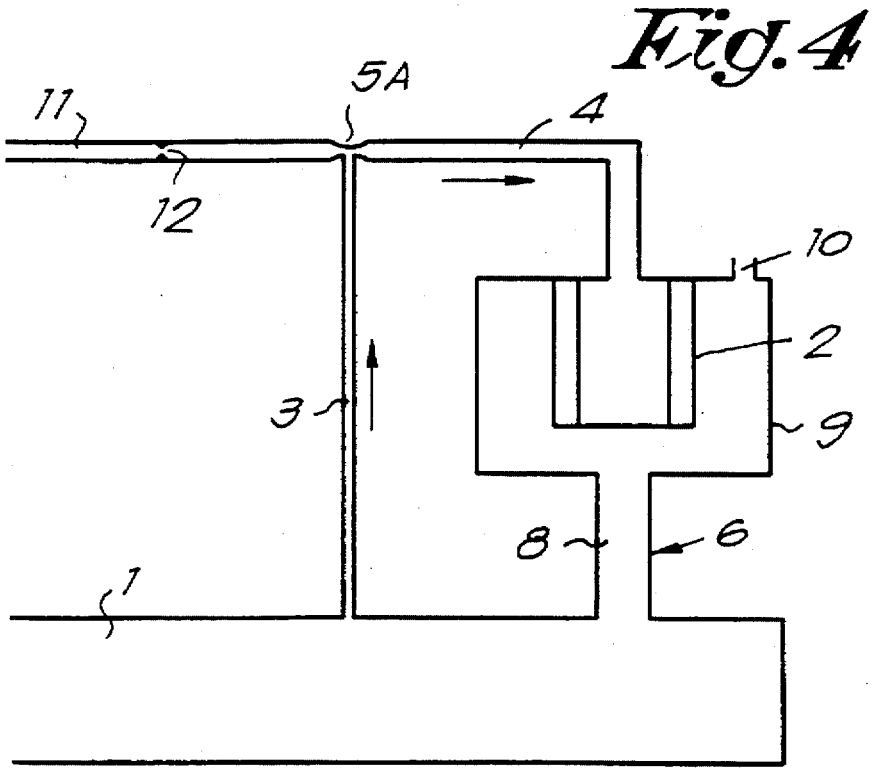
FIG. 4 schematically shows a third variant of the device for separating oil.

FIG. 4 schematically shows an advantageous variant of the device according to FIG. 3.

The suction pump 5 consists of an ejector 5A on the inlet to which is connected a compressed-air line 11 and whose outlet opens into the filter 2 via the part 4 of the line 3-4 and whose Venturi suction part is connected to the sump 1 via the other part 3 of the line 3-4.

The compressed-air line 11 is part of the compressed-air network which is fed with compressed air from the compressor or another compressed-air source. In this compressed-air line 11 is mounted a restriction device or a pressure regulator 12 upstream of the ejector 5A.

The working of this variant is as follows.

When the ejector 5A is fed with a flow QE of compressed air via the pressure regulator 12, a certain flow Q1 of air polluted with oil is sucked out of the sump 1 via the part 3 of the line 3-4. The dimensions of the device are selected such that this flow Q1 is larger than the normal sump venting flow QS flowing in line 8 (see below).

In the ejector 5A, this polluted air is mixed with the compressed air and the flow QE+Q1 of the mixture is directed via the part 4 of the line 3-4 through the filter 2.

A part of the purified air, namely a flow which is equal to QE+QS can escape into the environment via the outlet 10. The drops of oil which are formed in the filter 2 drip off the filter and are carried back to the sump 1 via the return line 8 as a result of the force of gravity.

Together with the oil, also a flow Q1–QS of purified air also flows back to the sump 1 via the return line 8, so that the air content in this sump is constant once the balance is reached, and so that as a consequence the pressure is constant.

The flow Q1+QE which flows into the chamber, the size of the return line 8 and the size of the outlet 10 are preferably selected such that there is never created an excess pressure or underpressure in the sump 1 which is disadvantageous to the working of the sealings.

As the compressed air for the ejector 5A comes from a compressor or another compressed-air source and is already filtered and dried, the filter 2 has a relatively long life.

Figure 5:
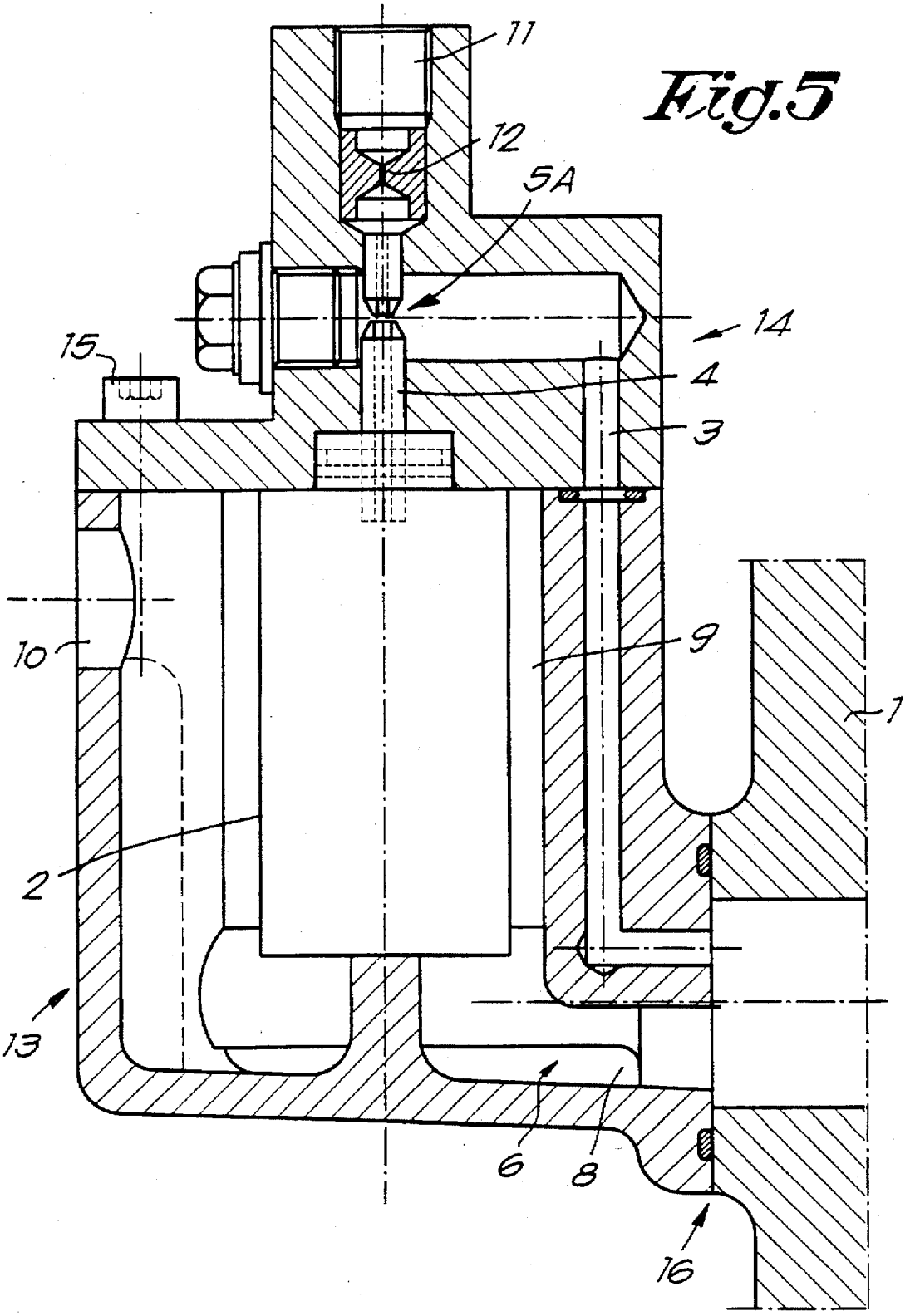
FIG. 5 shows a practical embodiment of the variant according to FIG. 4.

FIG. 5 shows a practical embodiment of the variant according to FIG. 4.

The return line 8, the chamber 9, the outlet 10 and a section of the part 3 of the line 3-4 are integrated in a component 13 in the shape of a small pot. The pressure regulator 12, the ejector 5A, the part 4 of the line 3-4 and the remainder of the part 3 are integrated in a second component 14 in the shape of a lid which is fixed to the component 13 by means of a bolt fastening 15.

The whole is connected to the sump 1 of the gearcase by means of a flange attachment 16.

The present invention is by no means limited to the embodiments described as examples and represented in the accompanying drawings; on the contrary, such a device for separating oil can be made according to all sorts of variants while still remaining within the scope of the invention as defined in the following claims.

I claim:

1. A vent system for venting oil containing air from an oil containing reservoir of operating equipment that causes a flow $Q_S$ of air into the reservoir during operation and for separating oil from vented air, comprising:

an oil reservoir in communication with operating equipment causing a flow $Q_S$ of air into the reservoir during operation of the equipment;

an air/oil vent line in communication with atmosphere above the oil in the reservoir;

a suction pump having a suction inlet and a discharge outlet;

said air/oil vent line connected to said pump suction inlet;

a filter in communication with the pump discharge outlet arranged to receive the outlet flow of air/oil from said outlet, said filter including an oil separation device for separating oil from air/oil discharged from the pump outlet, said filter also arranged to discharge air from which oil has been removed to atmosphere;

said suction pump and air/oil vent line configured to circulate flow of air/oil to said filter at a flow rate $Q_1$ that is greater than $Q_S$;

an air inlet vent line providing free communication between atmosphere and said reservoir, said air inlet vent line configured to permit a flow of atmospheric air into the reservoir at a rate corresponding at least to $Q_1-Q_S$;

whereby overpressurization and underpressurization of the reservoir relative to atmosphere is avoided during operation of the operating equipment.

2. The vent system according to claim 1, including an oil return line extending from the filter to the reservoir for returning separated oil to the reservoir.

3. The vent system as claimed in claim 2, wherein said air inlet vent line and said oil return line are one and the same structure.

4. The vent system according to claim 1, including a chamber enclosing said filter and for receiving separated oil and filtered air discharge from the filter;

a vent communicating said chamber to atmosphere;

said air inlet vent line in communication with said chamber.

5. A vent system as claimed in claim 4, including an oil return line communicating the housing to the reservoir, said air inlet vent line and said oil return line constituting one and the same structure.

6. The vent system according to claim 1, wherein said suction pump is a compressed air actuated ejector pump including a venturi suction section in communication with said pump inlet;

said pump outlet arranged to discharge actuating air and air/oil sucked into said pump inlet directly into said filter;

a pressure regulator adapted to regulate flow of actuating air into the pump;

a chamber enclosing said filter and for receiving separated oil and filtered air discharge from the filter;

a vent communicating said chamber to atmosphere;

said air inlet vent line in communication with said chamber;

an oil return line communicating the housing to the reservoir, said air inlet vent line and said oil return line constituting one and the same structure;

said air/oil vent line, pump and pressure regulator integrated into a first vent system component;

said filter, chamber, air vent inlet line and oil return line integrated into a second vent system component;

said first and second vent system components being directly connected together.

7. A vent system according to claim 6, wherein said equipment is a compressor and said ejector pump is adapted to receive compressed actuating air from said air compressor.

8. A method of venting an oil containing reservoir of operating equipment that supplies air to the reservoir at a flow rate $Q_S$ during its operation and for separating entrained oil from the vented air comprising the steps of:

sucking air with entrained oil from the reservoir using a suction pump through an air/oil vent line at a flow rate $Q_1$ that is greater than $Q_S$;

discharging the air with entrained oil into a filter arranged to separate oil from the air;

separating the entrained oil from the air in the filter and discharging the air from the filter into atmosphere;

admitting a flow of atmosphere air into the reservoir at a flow rate of at least $Q_1-Q_S$ so that the air pressure in the reservoir is never overpressurized or underpressurized relative to atmosphere as a result of the $Q_S$ and $Q_1$ flows.

9. A method according to claim 8, including returning separated oil from the filter to the reservoir.

* * * * *